United States Patent [19]

Broze et al.

[11] Patent Number: 4,806,260

[45] **Date of Patent: * Feb. 21, 1989**

[54] BUILT NONAQUEOUS LIQUID NONIONIC LAUNDRY DETERGENT COMPOSITION CONTAINING ACID TERMINATED NONIONIC SURFACTANT AND QUARTERNARY AMMONIUM SOFTENER AND METHOD OF USE

[75] Inventors: Guy Broze, Grace-Hollogne; Danielle Bastin, Soumangne, both of Belgium

[73] Assignee: Colgate-Palmolive Company, New York, N.Y.

[ * ] Notice: The portion of the term of this patent subsequent to Nov. 11, 2003 has been disclaimed.

[21] Appl. No.: 831,752

[22] Filed: Feb. 21, 1986

[51] Int. Cl.[4] ..... D06M 9/00; C11D 1/06

[52] U.S. Cl. ..... 252/8.8; 252/89.1; 252/135; 252/174.21; 252/174.22; 252/528; 252/547; 252/546; 252/DIG. 1; 252/DIG. 14

[58] Field of Search ..... 252/546, 135, 139, 174.16, 252/99, 102, 174.21, 8.8, 528, 547, 174.22, DIG 1, DIG. 14, 89.1

[56] References Cited

U.S. PATENT DOCUMENTS

| | | | |
|---|---|---|---|
| 3,594,409 | 7/1971 | Lachampt et al. | 424/61 |
| 3,630,929 | 12/1971 | Van Dijk | 252/136 |
| 3,741,911 | 6/1973 | Shane | 252/527 |
| 3,990,991 | 11/1976 | Gerstein | 252/542 |
| 4,134,840 | 1/1979 | Minegishi et al. | 252/8.9 |
| 4,264,457 | 4/1981 | Beeks et al. | 252/8.75 |
| 4,316,812 | 2/1982 | Hancock et al. | 252/99 |
| 4,362,530 | 12/1982 | Gross et al. | 8/529 |
| 4,443,362 | 4/1984 | Guth et al. | 252/545 |
| 4,473,489 | 9/1984 | Bartnick et al. | 252/354 |
| 4,622,173 | 11/1986 | Broze et al. | 252/135 |

FOREIGN PATENT DOCUMENTS 1419351 12/1975 United Kingdom .

*Primary Examiner*—Josephine Barr

*Attorney, Agent, or Firm*—N. Blumenkopf; M. M. Grill; R. C. Sullivan

[57] ABSTRACT

A macro salt complex of an acid terminated nonionic surfactant and a quaternary ammonium surface active agent provide improved detergent and fabric softening properties for built nonaqueous liquid nonionic surfactant laundry detergent compositions. The fabric softening properties of the compositions can be improved while maintaining or improving the detergent properties of the composition. The macro salt complex can be used in liquid nonionic surfactant heavy duty detergents and in powder detergent compositions.

22 Claims, No Drawings

BUILT NONAQUEOUS LIQUID NONIONIC LAUNDRY DETERGENT COMPOSITION CONTAINING ACID TERMINATED NONIONIC SURFACTANT AND QUARTERNARY AMMONIUM SOFTENER AND METHOD OF USE

BACKGROUND OF THE INVENTION (1) Field of Invention

This invention relates to nonaqueous liquid fabric treating compositions. Particularly, this invention relates to nonaqueous liquid laundry detergent compositions which have good detergency and softening properties and which are stable against phase separation and gelation and are easily pourable and to the use of these compositions for cleaning and softening soilded fabrics.

More particularly this invention relates to a liquid detergent-softening composition and a method for cleaning and softening fabrics in the wash cycle of a laundering operation. Specifically, the present invention relates to detergent-softening compositions adapted for use in the wash cycle of a laundering operation, the composition including an acid terminated nonionic surfactant and a water dispersible cationic quaternary ammonium compound softening agent, and a nonionic surfactant.

(2) Discussion of Prior Art

Compositions useful for treating fabrics to improve the softness and feel characteristics thereof are known in the art.

When used in domestic laundering, the fabric softeners are typically added to the rinse water during the rinse cycle having a duration of only from about 2 to 5 minutes. Consequently, the consumer is required to monitor the laundering operation or take other precautions so that the fabric softener is added at the proper time. This requires the consumer to return to the washing machine either just prior to or at the beginning of the rinse cycle of the washing operation which is obviously burdensome to the consumer. In addition, special precaution has to be taken to use a proper amount of the fabric softener so as to avoid over dosage which may render the clothes water repellant by depositing a greasy film on the fabric surface, as well as imparting a certain degree of yellowness to the fabrics.

As a solution to the above-noted problems, it has been known to use fabric softeners which are compatible with common laundry detergents so that the softeners can be combined with the detergents in a single package for use during the wash cycle of the laundering operation. Examples of such wash cycle added fabric softening compositions are shown in U.S. Pat. Nos. 3,351,438, 3,660,286 and 3,703,480 and many others. In general, these wash cycle fabric softening compositions contain a cationic quaternary ammonium fabric softener and additional ingredients which render the softening compounds compatible with the common laundry detergents.

There have been many disclosures in the art relating to detergent compositions containing cationic softening agents, including the quaternary ammonium compound softening agents, and nonionic surface-active compounds. As representative of this art, mention can be made of U.S. Pat. Nos. 4,264,457, 4,239,659, 4,259,217, 4,222,905, 3,951,879, 3,360,470, 3,351,483, 3,644,203, etc. In addition, U.S. Pat. Nos 3,537,993, 3,583,912, 3,983,079, 4,203,872 and 4,264,479 specifically disclose combinations of nonionic surface-active agent, cationic fabric softener and another ionic surfactant or modifier, such as zwitterionic surfactants, amphoteric surfactants, and the like.

While many of these prior art formulations provide satisfactory cleaning and/or softening under many different conditions they still suffer from the defects of not providing adequate softening—e.g. comparable to rinse cycle —added softeners.

U.S. Pat. No. 3,920,565 discloses a liquid rinse cycle fabric softener composition containing 2 to 15% of a cationic fabric softener and 0.5 to 4.0% of an alkali metal salt of a fatty acid of from 16 to 22 carbon atoms (soap) and optionally, up to 2% of a nonionic emulsifier, the balance water. The dihigher alkyl dimethyl ammonium chlorides are the preferred cationics, although mono-higher alkyl quats are also mentioned.

It is generally accepted in the art that the mono-higher alkyl quaternary ammonium compounds, such as, for example, stearyltrimethyl ammonium chloride, being relatively water soluble, are less effective softeners than the dihigher alkyl cationic quaternary softeners (see, for example, U.S. Pat. No. 4,326,965), and, therefore, their use in conjunction with, for example, anionic detergents, such as fatty acid soaps, with which they are capable of forming softening complexes has been suggested for use as rinse cycle fabric softeners.

It is also known from U.S. Pat. No. 3,997,453 that stable, fabric softening compositions having improved dispersibility in cold water as used in the rinse cycle, are provided by a cationic quaternary ammonium compound, as the sole softener, and an anionic sulfonate at a weight ratio of cationic to anionic of from about 80:1 to 3:1. This patent discloses both mono-higher and dihigher alkyl cationic quaternary softening compounds and also discloses alkyl benzene sulfonates as the anionic compound. According to the '453 patent, the addition of minor amounts of the anionic sulfonate to water dispersions of the excess amount of quaternary softener reduces the viscosity of the dispersion and produces a homogeneous liquid which is readily dispersible in cold water (i.e. the rinse cycle of an atomatic washing machine).

As mentioned above, however, it has been recognized for some time that it would be highly desirable as a matter of convenience to employ the fabric softening formulation concurrently with the detergent in the wash cycle of the washing machine.

U.S. Pat. No. 4,222,905 to Cockrell, Jr. discloses laundry detergent compositions which may be in liquid form and which are formulated from certain nonionic surfactants and certain cationic surfactants, including mono-higher alkyl quaternary ammonium compounds, such as tallowalkyltrimethyl ammonium halide, at a nonionic:cationic weight ratio of from 5:1 to about 1:1. This patent teaches that the amount of anion-producing materials should be minimized and preferably totally avoided.

Nonionic/cationic mixed surfactant detergent compositions having a nonionic:cationic weight ratio of from about 1:1 to 40:1 in which the nonionic surfactant is limited to the class having a hydrophilic-lipophilic balance (HLB) of from about 5 to about 17, and the cationic surfactant is limited to the class of mono-higher alkyl quaternary ammonium compounds in which the higher alkyl has from about 20 to about 30 carbon atoms, are disclosed by Murphy in U.S. Pat. No. 4,239,659. This patent provides a general disclosure that other adjunct components may be included in their conventional art-established levels for use which is stated to be from about 0 to about 40%. A broad list of adjunct components is given including semi-polar nonionic, anionic, zwitterionic and ampholytic cosurfactants, builders, dyes, fillers, enzymes, bleaches, and many others. There are no examples using, and no disclosure of, anionic surfactants; however, it is stated that the cosurfactants must be compatible with the nonionic and cationic and can be any of the anionics disclosed in U.S. Pat. No. 4,259,217 to Murphy.

Liquid nonaqueous nonionic heavy duty laundry detergent compositions are also well known in the art. For instance, compositions of that type may comprise a liquid nonionic surfactant in which are dispersed particles of a builder, as shown for instance in the U.S. Pat. Nos. 4,316,812, 3,630,929 and 4,264,466 and British Pat. Nos. 1,205,711, 1,270,040 and 1,600,981.

The related pending applications assigned to the common assignee are Ser. No. 687,815 filed Dec. 31, 1984; Ser. No. 597,793 filed Apr. 6, 1984; Ser. No. 597,948 filed Apr. 9, 1984; Ser. No. 767,568 filed Aug. 02, 1985; Ser. No. 687,816 filed Dec. 31, 1984; and Ser. No. 661,775 filed Oct. 17, 1984.

The applications are directed to liquid nonaqueous nonionic laundry detergent compositions.

Liquid detergents are often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are nondusting, and they usually occupy less storage space. Additionally, the liquid detergents may have incorporated in their formulations materials which could not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

The present inventors have been involved in studying the behavior of nonionic liquid surfactant systems with particulate matter suspended therein. Of particular interest has been nonaqueous built laundry liquid detergent compositions and the problem of settling of the suspended builder and other laundry additives as well as the problem of gelling associated with nonionic surfactants. These considerations have an impact on, for example, product stability, pourability and dispersibility.

It is known that one of the major problems with built liquid laundry detergents is their physical stability. This problem stems from the fact that the density of the solid particles dispersed in the nonionic liquid surfactant is higher than the density of the liquid surfactant.

Therefore, the dispersed particles tend to settle out. Two basic solutions exist to solve the settling out problem: increase nonionic liquid viscosity and reduce the dispersed solid particle size.

It is known that suspensions can be stabilized against settling by adding inorganic or organic thickening agents or dispersants, such as, for example, very high surface area inorganic materials, e.g. finely divided silica, clays, etc., organic thickeners, such as the cellulose ethers, acrylic and acrylamide polymers, polyelectrolytes, etc. However, such increases in suspension viscosity are naturally limited by the requirement that the liquid suspension be readily pourable and flowable, even at low temperature. Furthermore, these additives do not contribute to the cleaning performance of the formulation.

Grinding to reduce the particle size provides the following advantages:

1. Specific surface area of the dispersed particles is increased, and, therefore, particle wetting by the nonaqueous vehicle (liquid nonionic) is proportionately improved.

2. The average distance between dispersed particles is reduced with a proportionate increase in particle-to-particle interaction. Each of these effects contributes to increase the rest-gel strength and the suspension yield stress while at the same time, grinding significantly reduces plastic viscosity.

The yield stress is defined as the minimum stress necessary to induce a plastic deformation (flow) of the suspension. Thus, visualizing the suspension as a loose network of dispersed particles, if the applied stress is lower than the yield stress, the suspension behaves like an elastic gel and no plastic flow will occur. Once the yield stress is overcome, the network breaks at some points and the sample begins to flow, but with a very high apparent viscosity. If the shear stress is much higher than the yield stress, the pigments are partially shear-deflocculated and the apparent viscosity decreases. Finally; if the shear stress is much higher than the yield stress value, the dispersed particles are completely shear-deflocculated and the apparent viscosity is very low, as if no particle interaction were present.

Therefore, the higher the yield stress of the suspension, the higher the apparent viscosity at low shear rate and the better is the physical stability against settling of the product.

In addition to the problem of settling or phase separation, the nonaqueous liquid laundry detergents based on liquid nonionic surfactants suffer from the drawback that the nonionics tend to gel when added to cold water. This is a particularly important problem in the ordinary use of European household automatic washing machines where the user places the laundry detergent composition in a dispensing unit (e.g. a dispensing drawer) of the machine. During the operation of the machine the detergent in the dispenser is subjected to a stream of cold water to transfer it to the main body of wash solution. Especially during the winter months when the detergent composition and water fed to the dispenser are particularly cold, the detergent viscosity increases markedly and a gel forms. As a result some of the composition is not flushed completely off the dispenser during operation of the machine, and a deposit of the composition builds up with repeated wash cycles, eventually requiring the user to flush the dispenser with hot water.

The gelling phonomenon can also be a problem whenever it is desired to carry out washing using cold water as may be recommended for certain synthetic and delicate fabrics or fabrics which can shrink in warm or hot water.

The tendency of concentrated detergent compositions to gel during storage is aggrevated by storing the compositions in unheated storage areas, or by shipping the compositions during winter months in unheated transportation vehicles.

Partial solutions to the gelling problem have been proposed, for example, by diluting the liquid nonionic with certain viscosity controlling solvents and gel-inhibiting agents, such as lower alkanols, e.g. ethyl alcohol (see U.S. Pat. No. 3,953,380), alkali metal formates and adipates (see U.S. Pat. No. 4,368,147), hexylene glycol, polyethylene glycol, etc. and nonionic structure modification and optimization. As an example of nonionic surfactant modification one particularly successful result has been achieved by acidifying the hydroxyl moiety end group of the nonionic molecule. The advantages of introducing a carboxylic acid at the end of the nonionic include gel inhibition upon dilution; decreasing the nonionic pour point; and formation of an anionic surfactant when neutralized in the washing liquor. Nonionic structure optimization has centered on the chain length of the hydrophobic-lipophilic moiety and the number and make-up of alkylene oxide (e.g. ethylene oxide) units of the hydrophilic moiety. For example, it has been found that a $C_{13}$ fatty alcohol ethoxylated with 8 moles of ethylene oxide presents only a limited tendency to gel formation.

Nevertheless, improvements are desired in both the stability and gel inhibition of nonaqueous liquid fabric treating compositions.

BRIEF DESCRIPTION OF THE INVENTION

In accordance with the present invention a highly concentrated stable nonaqueous liquid laundry detergent composition with good detergent and fabric softening properties is prepared by adding to the composition small effective amounts of an acid terminated nonionic surfactant and a quaternary ammonium salt surfactant complex.

The softening and detergent performance of a nonionic detergent composition is significantly enhanced by adding to the nonionic detergent composition an approximately 1:1 complex of an acid terminated nonionic surfactant and a cationic softener. This enhancement of the softening performance is achieved without sacrificing, and in most cases, with improvement in the detergent cleaning performance.

The compositions of the present invention contain as essential ingredients an acid terminated nonionic surfactant and a quaternary ammonium surface active agent fabric softener.

The acid terminated nonionic surfactants consist of a nonionic surfactant which has been modified to convert a free hydroxyl group thereof to a moiety having a free carboxyl group, such as an ester or a partial ester of a nonionic surfactant and a polycarboxylic acid or acid anhydride. The nonionic surfactants used to prepare the acid terminated surfactants are preferably the polylower alkyoxylated higher alkanols wherein the alkanol is of 9 to 18 carbon atoms and wherin the number of mols of lower alkylene oxide (2 or 3 carbon atoms) is from 3 to 12. The nonionic surfactants which are the precursors for the acid terminated nonionics are also used as the major detergent constituent of the formulation.

Fabric softening agents are used to render fabrics or textiles soft, and the terms "softening" and "softener" refer to the handle, hand, touch or feel; this is the tactile impression given by fabrics or textiles to the hand or body and is of aesthetic and commercial importance. The fabric softeners use in the present invention are cationic surfactants. The cationic surfactants that are useful are those surface active compounds which contain a long chain hydrocarbon hydrophobic group in their molecular structure and a hydrophile group, i.e. water soluble salt forming anion group.

The quaternary ammonium cationic surface active fabric softeners of the present invention are well known and are commercially available. The quaternary ammonium compounds have been used as fabric softeners and have been used as surface active detergents.

The preferred quaternary ammonium compounds used in accordance with the present invention are the mono and di-higher alkyl lower alkyl quaternary ammonium salts and the mono and di higher alkyl di ethoxylated quaternary ammonium salts.

The quaternary ammonium salts are believed to react with the acid terminated nonionic surfactant to form a macro salt complex reaction product. This macro salt complex is slowly hydrolized during the wash cycle to release the quaternary ammonium salt fabric softener. Because of the slow release of the fabric softener sufficient time is provided for the laundry to be cleaned before the fabric softener is deposited on the laundry.

The preferred cationic quaternary ammonium fabric softeners of the present invention are members of the group consisting of:

I. Mono-higher alkyl tri-lower alkyl quaternary ammonium salts.

II. Di-higher alkyl di-lower alkyl quaternary ammonium salts.

III. Mono-higher alkyl mono-lower alkyl diethoxylated quaternary ammonium salts; and IV. Di-higher alkyl diethoxylated quaternary ammonium salts.

The cationic quaternary ammonium compound softening agents of the present invention are briefly described as follows:

The formula I compounds are mono-higher alkyl tri-lower alkyl quaternary ammonium salts represented by the formula

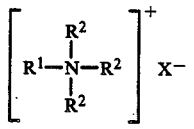

(I)

wherein $R^1$ is a long chain aliphatic radical having from 10 to 22 carbon atoms, the $R^2$'s are, independently, lower alkyl or hydroxy alkyl having from 1 to 4 carbon atoms, and X is a water soluble salt forming anion.

The formula II compounds are di-higher alkyl di-lower alkyl quaternary ammonium salts represented by the formula

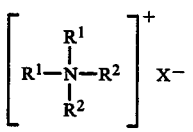

(II)

wherein $R^1$'s are, independently, long chain aliphatic radicles having from 10 to 22 carbon atoms, the $R^2$'s, are, independently, lower alkyl or hydroxy alkyl having from 1 to 4 carbon atoms, and X is a water soluble salt forming anion.

The formula III compounds are mono-higher alkyl mono-lower alkyl diethoxy quaternary ammonium compounds represented by the formula

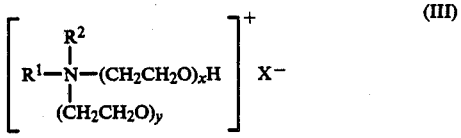

(III)

wherein $R^1$ is a long chain aliphatic radical having from 10 to 22 carbon atoms, $R^2$ is a lower alkyl or hydroxy alkyl having from 1 to 4 carbon atoms, x and y are each positive numbers of at least 1 and the sum of x+y is from 2 to 15, and X is a writer soluble salt forming anion.

The formula IV compounds are di higher alkyl diethoxylated quaternary ammonium salts represented by the formula

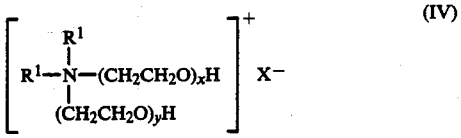

(IV)

wherein $R^1$'s are independently, long chain aliphatic radicles having from 10 to 22 carbon atoms, x and y are each positive numbers of at least 1 and the sum of x+y is from 2 to 15, and X is a water soluble salt forming anion.

In order to improve the viscosity characteristics of the composition an acid terminated nonionic surfactant in excess of the amount used to form the macro salt complex with the quaternary ammonium fabric softener can be added. To further improve the viscosity characteristics of the composition and the storage properties of the composition there can be added to the composition viscosity improving and anti gel agents such as alkylene glycols, poly alkylene glycols and alkylene glycol mono alkyl ethers and anti settling agents such as phosphoric acid ester and aluminum stearate. In an embodiment of the invention the detergent composition contains an acid terminated nonionic/quaternary ammonium macro salt complex, additional acid terminated nonionic surfactant, an alkylene glycol mono alkyl ether and an anti settling stabilizing agent.

Sanitizing or bleaching agents and activators therefor can be added to improve the bleaching and cleansing characteristics of the composition.

In an embodiment of the invention the builder components of the composition are ground to a particle size of less than 100 microns and to preferably less than 10 microns to further improve the stability of the suspension of the builder components in the liquid nonionic surfactant detergent.

In addition other ingredients can be added to the composition such as anti-incrustation agents, anti-foam agents, optical brighteners, enzymes, anti-redeposition agents, perfume and dyes.

The presently manufactured washing machines for home use normally operate at washing temperatures of up to 100° C. About up to 18 gallons (70 liters) of water are used during the wash and rinse cycles.

About 250 gms of powder detergent per wash is normally used.

In accordance with the present invention where the highly concentrated liquid detergent is used normally only 100 gms (77 cc) of the liquid detergent softener composition is required to wash and soften a full load of dirty laundry.

Accordingly, in one aspect the present invention provides a liquid heavy duty laundry composition composed of a suspension of an anionic detergent builder salt, e.g. a phosphate builder salt, in a liquid nonionic surfactant wherein the composition includes an effective amount of an acid terminated nonionic surfactant-/quaternary ammonium fabric softener macro salt complex provide good detergent and good fabric softening properties.

According to another aspect, the invention provides a concentrated liquid heavy duty laundry detergent composition which is stable, non-settling in storage and non-gelling in storage and in use. The liquid compositions of the present invention are easily pourable, easily measured and easily put into the washing machine.

According to another aspect, the invention provides a method for dispensing a liquid nonionic laundry detergent composition into and/or with cold water without undergoing gelation. In particular, a method is provided for filling a container with a nonaqueous liquid laundry detergent composition in which the detergent is composed, at least predominantly, of a liquid nonionic surface active agent and for dispensing the composition from the container into an aqueous wash bath, wherein the dispensing is effected by directing a stream of unheated water onto the composition such that the composition is carried by the stream of water into the wash bath.

ADVANTAGES OVER THE PRIOR ART

The addition of the acid terminated nonionic surfactant/quaternary ammonium fabric softener salt complex to the detergent compositions overcomes the need to separately add a fabric softener to the automatic laundry washing machine after the wash cycle.

The concentrated nonaqueous liquid nonionic surfactant laundry detergent compositions of the present invention have the advantages of being stable, non-settling in storage, and non-gelling in storage. The liquid compositions are easily pourable, easily measured and easily put into the laundry washing machines.

OBJECTS OF THE INVENTION

It is an object of the present invention to provide a stable liquid heavy duty nonaqueous nonionic detergent composition containing a quaternary ammonium fabric softener.

It is an other object of the invention to provide liquid fabric treating compositions which are suspensions of insoluble inorganic particles in a nonaqueous liquid and which are storage stable, easily pourable and dispersible in cold, warm or hot water.

Another object of this invention is to improve softening performance of liquid detergent compositions containing acid terminated nonionic surfactant/ quaternary ammonium compound softening agents and nonionic detergent compounds without adversely effecting overall cleaning performance.

Another object of this invention is to formulate stable liquid detergent-softener compositions using acid terminated nonionic surfactant/ quaternary ammonium cationic softeners with nonionic surfactants as the major surfactant component.

Another object of the invention is to provide a liquid laundry detergent composition capable of washing soiled fabrics in an aqueous wash liquid, which composition includes a nonionic surface active agent as the major surfactant, and an acid terminated nonionic surfactant and a quaternary ammonium compound cationic fabric softener in about equal molar amounts.

Another object of this invention is to formulate highly built heavy duty nonaqueous liquid nonionic surfactant laundry detergent compositions which can be poured at all temperatures and which can be repeatedly dispersed from the dispensing unit of European style automatic laundry washing machines without fouling or plugging of the dispenser even during the winter months.

A specific object of this invention is to provide non-gelling, stable suspensions of heavy duty built nonaqueous liquid nonionic laundry detergent composition which include an effective amount of an acid terminated nonionic surfactant/quaternary ammonium surface active agent fabric softener to improve the fabric softening properties of the composition while at the same time maintaining or improving the detergent properties of the composition.

These and other objects of the invention which will become more apparent from the following detailed description of preferred embodiments are generally provided for by preparing a detergent composition by adding to the nonaqueous liquid nonionic surfactant an effective amount of an acid terminated nonionic surfactant/quaternary ammonium softener macro salt complex sufficient to improve the fabric softening properties, wherein said composition includes inorganic or organic fabric treating additives, e.g. viscosity improving agents and one or more anti-gel agents, anti-incrustation agents, pH control agents, bleaching agents, bleach activators, anti-foam agents, optical brighteners, enzymes, anti-redeposition agents, perfume and dyes.

DETAILED DESCRIPTION OF THE INVENTION

In accordance with the present invention the fabric softening properties of the detergent composition are substantially improved by the addition of an acid terminated nonionic surfactant/quaternary ammonium softener macro salt complex.

The addition of minor amounts of the macro salt complex is sufficient to substantially improve the softening properties of the composition while maintaining or improving the detergent properties of the composition.

The compositions of the present invention contain as essential ingredients an acid terminated nonionic surfactant and a quaternary ammonium softener. The quaternary ammonium softener can comprise one or more of the quaternary ammonium surface active agents.

The acid terminated nonionic surfactants consist of a nonionic surfactant which has been modified to convert a free hydroxyl group thereof to a moiety having a free carboxyl group, such as an ester or a partial ester of a nonionic surfactant and a polycarboxylic acid or anhydride.

The nonionic surfactants used as precursors to prepare the acid terminated surfactants are preferably the poly-lower alkoxylated higher alkanols wherein the alkanol is of 9 to 18 carbon atoms and wherein the number of mols of lower alkylene oxide (of 2 or 3 carbon atoms) is from 3 to 12. Of such materials it is preferred to employ those wherein the higher alkanol is a fatty alcohol of 9 to 11 or 12 to 15 carbon atoms and which contain from 5 to 8 or 5 to 9 lower alkoxy groups per mol. Preferably the lower alkoxy is ethoxy but in some instances, it may be desirably mixed with propoxy.

The nonionic surfactants are also used as the major detergent constituent of the formulation and are discussed in detail below. The following discussed nonionic surfactants can also be used to prepare the acid terminated nonionic surfactant. The acid terminated nonionic surfactants contain a free carboxylic acid group and can be broadly characterized as alkyl polyether carboxylic acids.

Specific examples of acid terminated nonionic surfactants include the half-esters of Product A with succinic anhydride, the ester or half ester of Dobanol 25-7 with succinic anhydride, and the ester of half ester of Dobanol 91-5 with succinic anhydride. Instead of succinic anhydride, other polycarboxylic acids or anhydrides can be used, e.g. maleic acid, maleic acid anhydride, glutaric acid, malonic acid, phthalic acid, phthalic anhydride, citric acid and the like.

The acid terminated nonionic surfactants can be prepared as follows:

Acid Terminated Product A. 400 g of Product A nonionic surfactant which is a $C_{13}$ to $C_{15}$ alkanol which has been alkoxylated to introduce 6 ethylene oxide and 3 propylene oxide units per alkanol unit is mixed with 32 g of succinic anhydride and heated for 7 hours at 100° C. The mixture is cooled and filtered to remove unreacted succinic material. Infrared analysis indicated that about one half of the nonionic surfactant has been converted to the acidic half-ester thereof.

Acid Terminated Dobanol 25-7. 522g of Dobanol 25-7 nonionic surfactant which is the product of ethoxylation of a $C_{12}$ to $C_{15}$ alkanol and has about 7 ethylene oxide units per molecule of alkanol is mixed with 100 g of succinic anhydride and 0.1 g of pyridine (which acts as an esterification catalyst) and heated at 260° C. for 2 hours, cooled and filtered to remove unreacted succinic material. Infrared analysis indicates that substantially all the free hydroxyls of the surfactant have reacted.

Acid Terminate Dobanol 91-5. 1000 g of Dobanol 91-5 nonionic surfactant which is the product of ethoxylation of a $C_9$ to $C_{11}$ alkanol and has about 5 ethylene oxide units per molecule of alkanol is mixed with 265 g of succinic anhydride and 0.1 g of pyridine catalyst and heated at 260° C. for 2 hours, cooled and filtered to remove unreacted succinic material. Infrared analysis indicates that substantially all the free hydroxyls of the surfactant have reacted.

Other esterification catalysts, such as an alkali metal alkoxide (e.g. sodium methoxide) may be used in place of, or in admixture with, the pyridine.

The acid terminated nonionic surfactant is preferably added to the quaternary ammonium softener to form the macro salt complex, and the macro salt complex added to the nonionic surfactant.

The quaternary ammonium cationic surface active agents that are useful in the present invention are those cationic surface active compounds which contain a long chain hydrocarbon hydrophobic group in their molecular structure and a hydrophile group, i.e. water soluble salt forming anion group.

The preferred cationic quaternary ammonium surface active fabric softener agents of the present invention are members of the group consisting of:

I. Mono-higher alkyl tri-lower alkyl quaternary ammonium salts.

II. Di-higher alkyl di-lower alkyl quaternary ammonium salts.

III. Mono-higher alkyl mono-lower alkyl diethoxylated quaternary ammonium salts; and IV. Di-higher alky diethoxylated quaternary ammonium salts.

The formula I cationic fabric softener agents used in the present invention are the mono-higher alkyl quaternary ammonium compounds represented by the following formula:

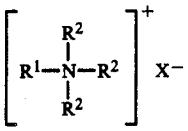

(I)

wherein R1 is a long chain aliphatic radical having from 10 to 22 carbon atoms, and the $R^2$'s are, independently, lower alkyl or hydroxy alkyl radicals and X is a water soluble salt forming anion such as halide, i.e. chloride, bromide, iodide; sulfate, nitrate, citrate, acetate, hydroxide, methosulfate, ethosulfate, phosphate, or similar inorganic or organic solubilizing radical. The $R^1$ carbon chain of the aliphatic radical containing 10 to 22 carbon atoms, especially 12 to 20, preferably 12 to 18, and especially preferably 16 to 18 carbon atoms, may be straight or branched, and saturated or unsaturated. The $R^2$ lower alkyl radicals have from 1 to 4 carbon atoms, e.g. methyl, ethyl, propyl and butyl, preferably 1 or 2 carbon atoms, especially preferably methyl, and may contain a hydroxyl radical.

The preferred ammonium salt is a mono-higher alkyl trimethyl ammonium chloride wherein the alkyl group is derived from tallow, hydrogenated tallow or stearic acid. Specific examples of quaternary ammonium fabric softener agents of the formula I suitable for use in the composition of the present invention include the following:

tallow trimethyl ammonium chloride
hydrogenated tallow trimethyl ammonium chloride
stearyl trimethyl ammonium chloride
stearyl triethyl ammonium chloride
cetyl trimethyl ammonium chloride
soya trimethyl ammonium chloride
stearyl dimethylethyl ammonium chloride
tallow-diisopropylmethyl ammonium chloride The corresponding sulfate, methosulfate, ethosulfate, bromide and hydroxide salts thereof, can also be used.

The formula II cationic fabric softener agents used in the present invention are the di-higher alkyl quaternary ammonium compounds represented by the following formula:

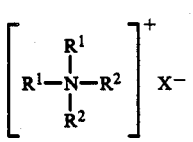

(II)

wherein $R^1$'s are, independently, long chain aliphatic radicals having from 10 to 22 carbon atoms, and the $R^2$'s are, independently, lower alkyl or hydroxy alkyl radicals and X is a water soluble salt forming anion such as halide, i.e. chloride, bromide, iodide; sulfate, nitrate, citrate, acetate, hydroxide, methosulfate, ethosulfate, phosphate, or similar inorganic or organic solubilizing radical. The $R^1$ carbon chains of the aliphatic radicals containing 10 to 22 carbon atoms, especially 12 to 20, preferably 12 to 18, and especially preferably 16 to 18 carbon atoms, may be straight or branched, and saturated or unsaturated. The $R^2$ lower alkyl radicals have from 1 to 4 carbon atoms, e.g. methyl, ethyl, propyl and butyl, preferably 1 or 2 carbon atoms, especially preferably methyl, and may contain a hydroxyl radical.

Typical cationics of formula II include the following:

distearyl dimethyl ammonium chloride
ditallow dimethyl ammonium chloride
dihexadecyl dimethyl ammonium chloride
distearyl dimethyl ammonium bromide
di(hydrogenated tallow) dimethyl ammonium bromide
ditallow isopropyl methyl ammonium chloride
distearyl di(isopropyl) ammonium chloride
distearyl dimethyl ammonium methosulfate.

A preferred class of cationics is of formula II wherein two of the $R^1$ groups are $C_{14}$ to $C_{18}$, one $R^2$ is methyl, or ethyl and one $R^2$ is methyl, ethyl, isopropyl, n-propyl, hydroxy ethyl or hydroxy propyl.

The formula III cationic fabric softener agents used in the present invention are the mono-higher alkyl diethoxylated quaternary ammonium compounds represented by the following formula:

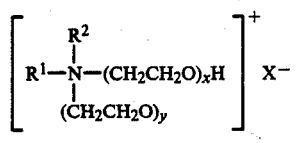

(III)

wherein $R^1$ is a long chain aliphatic radical having from 10 to 22 carbon atoms, and the $R^2$ is lower alkyl or hydroxyl alkyl radicals, x and y are each positive numbers of at least 1 and the sum of x+y is from 2 to 15, and X is a water soluble salt forming anion such as halide, i.e. chloride, bromide, iodide; sulfate, nitrate, citrate, acetate, hydroxide, methosulfate, ethosulfate, phosphate, or similar inorganic or organic solubilizing radical. The $R^1$ carbon chain of the aliphatic radical containing 10 to 22 carbon atoms, especially 12 to 20, preferably 12 to 18, and especially preferably 16 to 18 carbon atoms, may be straight or branched, and saturated or unsaturated. The $R^2$ lower alkyl radicals have from 1 to 4 carbon atoms, e.g. methyl, ethyl, propyl and butyl, preferably 1 or 2 carbon atoms, especially preferably methyl, and may contain a hydroxyl radical.

Typical examples of cationic quaternary ammonium fabric softener agents of the formula III suitable for use in the composition of the present invention include the following:

coco methyl diethoxylated (x+y=2) ammonium chloride
coco methyl diethoxylated (x+y=15) ammonium chloride
oleic methyl diethoxylated (x+y=2) ammonium chloride
oleic methyl diethoxylated (x+y=15) ammonium chloride
stearyl methyl diethoxylated (x+y=2) ammonium chloride stearyl methyl diethoxylated (x+y=15) ammonium chloride tallow methyl diethoxylated (x+y=10) ammonium chloride The formula IV cationic fabric softener agents used in the present invention are the di-higher alkyl diethoxylated quaternary ammonium compounds represented by the following formula:

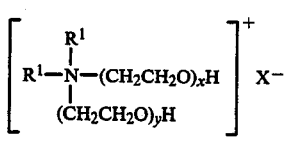

(IV)

wherein $R^1$'s are, independently, long chain aliphatic radical having from 10 to 22 carbon atoms, x and y are each positive numbers of at least 1 and the sum of x+y is from 2 to 15, and X is a water soluble salt forming anion such as halide, i.e. chloride, bromide, iodide; sulfate, nitrate, citrate, acetate, hydroxide, methosulfate, ethosulfate, phosphate, or similar inorganic or organic solubilizing radical. The $R^1$ carbon chains of the aliphatic radicals containing 10 to 22 carbon atoms, especially 12 to 20, preferably 12 to 18, and especially preferably 16 to 18 carbon atoms, may be straight or branched, and saturated or unsaturated.

Specific examples of cationic quaternary ammonium fabric softener agents of the formula IV suitable for use in the composition of the present invention include the following:

di-tallow diethoxylated (x+y=4) ammonium chloride (Ethoquat 2T/14)

di-hydrogenated tallow polyethoxylated (x+y=4) ammonium chloride distearyl polyethoxylated (x+y=10) ammonium chloride The mono and di-higher alkyl diethoxylated compounds are stable in both acid and alkaline solutions and possess greater water solubility and compatibility than other related compounds.

In the formula I to IV compounds, the long carbon chains are obtained from long chain fatty acids, such as those derived from tallow and soybean oil. The terms "soya," and "tallow," etc., as used herein refer to the source from which the long chain fatty alkyl chains are derived. Mixtures of the quaternary ammonium compound fabric softener agents can be used.

The linear higher alkyl quaternary ammonium salts are readily biodegradable and are preferred.

Nonionic surfactant detergent compositions containing acid terminated nonionic surfactant and quaternary ammonium softener macro salt complex provide good detergency properties and allow the quaternary ammonium softener to deposit on the fabric being cleaned to provide good fabric softener properties. The improvement in fabric softener properties is obtained while maintaining or improving the detergent properties of the position.

Though applicant does not want to be limited by any theory by which the detergent and softener properties are obtained, it is believed that a macro salt complex reaction product is formed between the acid terminated nonionic surfactant and the quaternary ammonium softener. When added to water during the wash cycle the macro salt complex is slowly hydrolyzed to release and deposit the quaternary ammonium softener on the laundry being cleaned. The hydrolysis and release of the quaternary ammonium softener is sufficiently slow or delayed that the detergent composition has enough time to remove dirt and stains from the laundry being washed prior to the release and deposit of the quaternary ammonium softener on the laundry being cleaned.

The slow hydrolysis or breakdown of the macro salt complex during the wash cycle allows a controlled release into the wash liquor of the quaternary ammonium softener such that the detergent composition has sufficient time to act to remove dirt and stain from the fabric being washed prior to the release and deposit of the quaternary ammonium softener on the fabric being washed.

Only small amounts of the acid terminated nonionic surfactant quaternary ammonium softener macro salt complex is required to obtain the significant improvements in softening properties. For example, based on the total weight of the nonionic liquid surfactant composition, suitable amounts of the macro salt complex range of from about 2.5% to about 35%, preferably from about 3.5% to about 25% and more preferably about 7.0 to 15%.

The relative proportions of acid terminated nonionic surfactant to quaternary ammonium softener that are used are selected such that all or substantially all of the quaternary ammonium softener present is interacted with the acid terminated nonionic to form the macro salt complex. Thus the mole ratio of acid terminated nonionic surfactant to quaternary ammonium softener used to form the macro salt complex can be 1.3:1 to 1:1.3, preferably about 1.1:1 to 1:1.1 and more preferably in about equal molar amounts of 1:1 to 1:1.

The macro salt complex is preferably prepared by simply mixing the acid terminated nonionic surfactant with the quaternary ammonium softener. The macro salt complex is advantageous added to the nonionic surfactant and the remaining constituents of the formulation are added, separately or in some cases premixed with other constituents, to the nonionic surfactant.

In addition to its action as a fabric softener agent, the higher alkyl quaternary ammonium salts have the additional advantages that they are cationic in character and are compatible with the nonionic surfactant component.

In order to improve the physical stability of the detergent composition, there can be added to the formulation physical anti-settling and stabilizing agents, such as, for example, an acidic organic phosphorus compound having an acidic—POH group, such as a partial ester of phosphorous acid and an alkanol, or an aluminum salt of a fatty acid.

Nonionic Surfactant Detergent

The nonionic synthetic organic detergents employed in the practice of the invention may be any of a wide variety of known compounds.

As is well known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pats. Nos. 4,316,812 and 3,630,929.

Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mol. Preferably, the lower alkoxy is ethoxy but in some instances, it may be desirably mixed with propoxy, the latter, if present, often being a minor (less than 50%) proportion.

Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols.

Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present composition as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company.

Other useful nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include Product A (a $C_{13}$–$C_{15}$ fatty alcohol condensed with 6 moles ethylene oxide and 3 moles propylene oxide), Product B (a $C_{13}$–$C_{15}$ fatty alcohol condensed with 7 moles propylene oxide and 4 moles ethylene oxide), and Product C (a $C_{13}$–$C_{15}$ fatty alcohol condensed with 5 moles propylene oxide and 10 moles ethylene oxide).

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 20% but, as is in the case of the mentioned Terigtols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of the viscosity and gel controlling compounds of the invention can also improve the properties of the detergents based on such nonionics. In some cases, as when a higher molecular weight polylower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures.

Another useful group of nonionic surfactants are the "Surfactant T" series of nonionics available from British Petroleum. The Surfactant T nonionics are obtained by the ethoxylation of secondary $C_{13}$ fatty alcohols having a narrow ethylene oxide distribution. The Surfactant T5 has an average of 5 moles of ethylene oxide; Surfactant T7 an average of 7 moles of ethylene oxide; Surfactant T9 an average of 9 moles of ethylene oxide and Surfactant T12 an average of 12 moles of ethylene oxide per mole of secondary $C_{13}$ fatty alcohol.

In the compositions of this invention, preferred nonionic surfactants include the $C_{12}$–$C_{15}$ secondary fatty alcohols with relatively narrow contents of ethylene oxide in the range of from about 7 to 9 moles, and the C9 to C11 fatty alcohols ethoxylated with about 5–6 moles ethylene oxide.

Mixtures of two or more of the liquid nonionic surfactants can be used and in some cases advantages can be obtained by the use of such mixtures.

Acid Terminated Nonionic Surfactant

The viscosity and gel properties of the liquid detergent compositions can be improved by including in the composition an effective amount an acid terminated liquid nonionic surfactant. The acid terminated nonionic surfactants as discussed above consist of a nonionic surfactant which has been modified to convert a free hydroxyl group thereof to a moiety having a free carboxyl group, such as an ester or a partial ester of a nonionic surfactant and a polycarboxylic acid or anhydride.

As disclosed in the commonly assigned copending application Ser. No. 597,948 filed Apr. 9, 1984, the disclosure of which is incorporated herein by reference, the free carboxyl group modified nonionic surfactants, which may be broadly characterized as polyether carboxylic acids, function to lower the temperature at which the liquid nonionic forms a gel with water.

The addition of the acid terminated nonionic surfactants to the liquid nonionic surfactant in excess of the amount required to form the macro salt complex aids in the dispensibility of the composition, i.e. pourability, and lowers the temperature at which the liquid nonionic surfactants form a gel in water without a decrease in their stability against settling. The excess acid terminated nonionic surfactant reacts in the washing machine water with the alkalinity of the dispersed builder salt phase of the detergent composition and acts as an effective anionic surfactant.

BUILDER SALTS

The liquid nonaqueous nonionic surfactant used in the compositions of the present invention has dispersed and suspended therein fine particles of inorganic and/or inorganic detergent builder salts.

The invention detergent compositions of the present invention can include water soluble and/or water insoluble detergent builder salts. Water soluble inorganic alkaline builder salts which can be used alone with the detergent compound or in admixture with other builders are alkali metal carbonates, bicarbonates, borates, phosphates, polyphosphates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred.

Since the compositions of this invention are generally highly concentrated, and, therefore, may be used at relatively low dosages, it is desirable to supplement any phosphate builder (such as sodium tripolyphosphate) with an auxiliary builder such as a poly lower carboxylic acid or a polymeric carboxylic acid having high calcium binding capacity to inhibit incrustation which could otherwise be caused by formation of an insoluble calcium phosphate.

A suitable lower poly carboxylic acid comprises alkali metal salts of lower polycarboxylic acids, preferably the sodium and potassium salts. Suitable lower polycarboxylic acids have two to four carboxylic acid groups. The preferred sodium and potassium lower polycarboxylic acids salts are the citric and tartaric acid salts.

The sodium citric acid salts are the most preferred, especially the trisodium citrate. The monosodium and disodium citrates can also be used. The monosodium and disodium tartaric acid salts can also be used. The alkali metal lower polycarboxylic acid salts are particularly good builder salts; because of their high calcium and magnesium binding capacity they inhibit incrustation which could otherwise be caused by formation of insoluble calcium and magnesium salts.

Other organic builders are polymers and copolymers of polyacrylic acid and polymaleic anhydride and the alkali metal salts thereof. More specifically such builder salts can consist of a copolymer which is the reaction product of about equal moles of methacrylic acid and maleic anhydride which has been completely neutralized to form the sodium salt thereof. The builder is commercially available under the tradename of Sokalan CP5. This builder serves when used even in small amounts to inhibit incrustation.

Examples of organic alkaline sequestrant builder salts which can be used with the detergent builder salts or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA), and triethanolammonium N-(2-hydroxyethyl)nitrilodiacetates. Mixed salts of these aminopolycarboxylates are also suitable.

Other suitable builders of the organic type include carboxymethylsuccinates, tartronates and glycollates. Of special value are the polyacetal carboxylates. The polyacetal carboxylates and their use in detergent compositions are described in application Ser. No. 767,570 filed Aug. 19, 1985, assigned to applicants' assignee and in a U.S. Pat. Nos. 4,144,226, 4,315,092 and 4,146,495.

The alkali metal silicates are useful builder salts which also function to adjust or control the pH and to make the composition anticorrosive to washing machine parts. Sodium silicates of $Na_2O/SiO_2$ ratios of from 1.6/1 to 1/3.2, especially about 1/2 to 1/2.8 are preferred. Potassium silicates of the same ratios can also be used. The preferred alkali metal silicate is sodium disilicate.

Other typical suitable builders include, for example, those disclosed in U.S. Pats. Nos. 4,316,812, 4,264,466 and 3,630,929. The inorganic builder salts can be used with the nonionic surfactant detergent compound or in admixture with other inorganic builder salts or with organic builder salts.

The water insoluble crystalline and amorphous aluminosilicate zeolites can be used. The zeolites generally have the formula $$(M_2O)_x \cdot (Al_2O_3)_y \cdot (SiO_2)_z \cdot wH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400meq lg.

Various crystalline zeolites (i.e. alumino-silicates) that can be used are described in British Pat. No. 1,504,168, U.S. Pat. No. 4,409,136 and Canadian Pats. Nos. 1,072,835 and 1,087,477, all of which are hereby incroporated by reference for such descriptions. An example of amorphous zeolites useful herein can be found in Belgium Pat. No. 835,351 and this patent too is incorporated herein by reference.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from any grit, sand, etc.) suitable for detergents contains at least 50% montmorillonite and thus its cation exchange capacity is at least about 50 to 75 meq per 100g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. 401,413 to Marriott and British Pat. 461,221 to Marriott and Guan.

Viscosity Control and Anti Gel Agents

The inclusion in the detergent composition of an effective amount of viscosity control and gel-inhibiting agents for the nonionic surfactant improves the storage properties, of the composition. The viscosity control and gel-inhibiting agents act to lower the temperature at which the nonionic surfactant will form a gel when added to water. Such viscosity control and gel-inhibiting agents can be for example, lower alkanol, e.g. ethyl alcohol (see U.S. Pat. No. 3,953,380), hexylene glycol, polyethylene glycol, for example, polyethylene glycol having a molecular weight of about 400 (PEG 400) and low molecular weight alkylene oxide lower mono-alkyl ether amphiphilic compounds.

Preferred viscosity control and gel-inhibiting compounds are the amphiphilic compounds. The amphiphilic compounds can be considered to be analagous in chemical structure to the ethoxylated and/or propoxylated fatty alcohol liquid nonionic surfactants but have relatively short hydrocarbon chain lengths ($C_2$ to $C_8$) and a low content of ethylene oxide (about 2 to 6 ethylene oxide groups per molecule).

Suitable amphiphilic compounds are represented by the following general formula $$R^3O(CH_2CH_2O)_nH$$

where $R^3$ is a $C_2$–$C_8$ alkyl group, and n is a number of from about 1 to 6, on average.

Specifically the compounds are lower ($C_2$ to $C_3$) alkylene glycol mono lower ($C_2$ to $C_5$) alkyl ethers.

More specifically the compounds are mono di- or tri lower ($C_2$ to $C_3$) alkylene glycol mono lower ($C_1$ to $C_5$) alkyl ethers.

Specif

Specific examples of suitable amphiphilic compounds include ethylene glycol monoethyl ether ($C_2H_5$—O—$CH_2CH_2OH$), diethylene glycol monobutyl ether ($C_4H_9$—O—$(CH_2CH_2O)_2H$), tetraethylene glycol monobutyl ether ($C_4H_7$—O—$(CH_2CH_2O)_4H$) and dipropylene glycol monomethyl ether $$(CH_3—O—(CH_2\underset{\underset{CH_3}{|}}{C}HO)_2H.$$

Diethylene glycol monobutyl ether is especially preferred.

The inclusion in the composition of the low molecular weight lower alkylene glycol mono alkyl ether decreases the viscosity of the composition, such that it is more easily pourable, improves the stability against settling and improves the dispersibility of the composition on the addition to warm water or cold water.

The compositions of the present invention have improved viscosity and stability characteristics and remain stable and pourable at temperatures as low as about 5° C. and lower.

In an embodiment of this invention a stabilizing agent which is an alkanol ester of phosphoric acid or an aluminum salt of a higher fatty acid can be added to the formulation.

Improvements in stability of the composition may be achieved by incorporation of a small effective amount of an acidic organic phosphorus compound having an acidic—POH group, such as a partial ester of phosphorous acid and an alkanol.

As disclosed in the commonly assigned copending application Ser. No. 597,793 filed Apr. 6, 1984 the disclosure of which is incorporated herein by reference, the acidic organic phosphorous compound having an acidic—POH group can increase the stability of the suspension of builders in the nonaqueous liquid nonionic surfactant.

The acidic organic phosphorus compound may be, for instance, a partial ester of phosphoric acid and an alcohol such as an alkanol which has a lipophilic character, having, for instance, more than 5 carbon atoms, e.g. 8 to 20 carbon atoms.

A specific example is a partial ester of phosphoric acid and a $C_{16}$ to $C_{18}$ alkanol (Empiphos 5632 from Marchon); it is made up of about 35% monoester and 65% diester.

The inclusion of quite small amounts of the acidic organic phosphorus compound makes the suspension stable against settling on standing but remains pourable, while, for the low concentration of stabilizer, e.g. below about 1%, its plastic viscosity will generally decrease.

Improvements in the stability and anti-settling properties of the composition may also be achieved by the addition of a small effective amount of an aluminum salt of a higher fatty acid to the composition.

The aluminum salt stabilizing agents are the subject matter of the commonly assigned copending application Ser. No. 725,455 filed Apr. 22, 1985, the disclosure of which is incorporated herein by reference.

The preferred higher aliphatic fatty acids will have from about 8 to about 22 carbon atoms, more preferably from about 10 to 20 carbon atoms, and especially preferably from about 12 to 18 carbon atoms. The aliphatic radical may be saturated or unsaturated and may be straight or branched. As in the case of the nonionic surfactants, mixtures of fatty acids may also be used, such as those derived from natural sources, such as tallow fatty acid, coco fatty acid, etc.

Examples of the fatty acids from which the aluminum salt stabilizers can be formed include, decanoic acid, dodecanoic acid, palmitic acid, myristic acid, stearic acid, oleic acid, eicosanoic acid, tallow fatty acid, coco fatty acid, mixtures of these acids, etc. The aluminum salts of these acids are generally commercially available, and are preferably used in the triacid form, e.g. aluminum stearate as aluminum tristearate $Al(C_{17}H_{35}COO)_3$. The monoacid salts, e.g. aluminum monostearate, $Al(OH)_2(C_{17}H_{35}COO)$ and diacid salts, e.g. aluminum distearate, $Al(OH)(C_{17}H_{35}COO)_2$, and mixtures of two or three of the mono-, di- and triacid aluminum salts can also be used. It is most preferred, however, that the triacid aluminum salt comprises at least 30%, preferably at least 50%, especially preferably at least 80% of the total amount of aluminum fatty acid salt.

The aluminum salts, as mentioned above, are commercially available and can be easily produced by, for example, saponifying a fatty acid, e.g. animal fat, stearic acid, etc., followed by treatment of the resulting soap with alum, alumina, etc.

Only very small amounts of the aluminum salt stabilizing agent is required to obtain an improvement in physical stability.

Bleaching Agents

The bleaching agents are classified broadly, for convenience, as chlorine bleaches and oxygen bleaches. Chlorine bleaches are typified by sodium hypochlorite (NaOCl), potassium dichloroisocyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No. 4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pat. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions.

Suitable sequestering agents for this purpose include the sodium salts of nitrilotriacetic acid (NTA), ethylene diamine tetraacetic acid (EDTA), diethylene triamine pentaacetic acid (DETPA), diethylene triamine pentamethylene phosphonic acid (DTPMP) sold under the tradename Dequest 2066; and ethylene diamine tetramethylene phosphonic acid (EDITEMPA). The sequestering agents can be used alone or in admixture.

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

In addition to the detergent builders, various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, and hydroxy-propyl methyl cellulose. A preferred anti-redeposition agent is sodium carboxymethyl cellulose having a 2:1 ratio of CM/MC which is sold under the tradename Relatin DM 4050.

Optical brighteners for cotton, polyamide and polyester fabrics can be used. Suitable optical brighteners include stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianalino stilbene sulfonate.

Enzymes, preferably proteolytic enzymes, such as subtilisin, bromelin, papain, trypsin and pepsin, as well as amylase type anzymes, lipase type enzymes, and mixtures thereof can be added. Preferred enzymes include protease slurry, esperase slurry and amylase. A preferred enzyme is Esperase SL8 which is protease. Anti-foam agents, e.g. silicon compounds, such as Silicane L 7604.

Bactericides, e.g. tetrachlorosalicylanilide and hexachlorophene, fungicides, dyes, pigments (water dispersible), preservatives, ultraviolet absorbers, anti-yellowing agents, such as sodium carboxymethyl cellulose, pH modifiers and pH buffers, color safe bleaches, perfume, and dyes and bluing agents such as ultramarine blue can be used.

The composition may also contain an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials disclosed in U.S. Pat. No. 3,630,929, in proportions of 0.1–10%, e.g. 1 to 5%. It is preferable, however, that compositions which form peroxyacids in the wash bath (e.g. compositions containing peroxygen compound and activator therefor) be substantially free of such compounds and of other silicates; it has been found, for instance, that silica and silicates promote the undesired decomposition of the peroxyacid.

In an embodiment of the invention the stability of the builder salts in the composition during storage and the dispersibility of the composition in water is improved by grinding and reducing the particle size of the solid builders to less than 100 microns, preferably less than 40 microns and more preferably to less than 10 microns. The solid builders, e.g. sodium tripolyphosphate (TPP), are generally supplied in particle sizes of about 100, 200 or 400 microns. The nonionic liquid surfactant phase can be mixed with the solid builders prior to or after carrying out the grinding operation.

In a preferred embodiment of the invention, the mixture of liquid nonionic surfactant and solid ingredients is subjected to an attrition type of mill in which the particle sizes of the solid ingredients are reduced to less than about 10 microns, e.g. to an average particle size of 2 to 10 microns or even lower (e.g. 1 micron). Preferably less than about 10%, especially less than about 5% of all the suspended particles have particle sizes greater than 10 microns. Compositions whose dispersed particles are of such small size have improved stability against separation or settling on storage. Addition of an excess, over that needed to form the macro salt complex, of the acid terminated nonionic surfactant compound can decrease the yield stress of such dispersions and aid in the dispersibility of the dispersions without a corresponding decrease in the dispersions stability against settling.

In the grinding operation, it is preferred that the proportion of solid ingredients be high enough (e.g. at least about 40% such as about 50%) that the solid particles are in contact with each other and are not substantially shielded from one another by the nonionic surfactant liquid. After the grinding step any remaining liquid nonionic surfactant can be added to the ground formulation. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 10 microns in the continuous ball mill.

In the preferred heavy duty liquid laundry detergent compositions of the invention, typical proportions (percent based on the total weight of composition, unless otherwise specified) of the ingredients are as follows:

Liquid nonionic surfactant detergent in the range of about 10 to 70, such as 20 to 60 percent, e.g. about 30 to 50%.

Acid terminated nonionic surfactant in an amount in the range of about 1 to 15, such as 1.5 to 10 percent, e.g. about 2 to 5% (in complex).

Quaternary ammonium salt softener agent in the range 1.5 to 20%, e.g. about 2.0 to 15, e.g. 5 to 10% (in complex).

Acid terminated nonionic surfactant/quaternary ammonium salt macro salt complex in an amount in the range of about 2.5 to 35, such as 3.5 to 25, e.g. 7 to 15%.

Detergent builder, such as sodium tripolyphosphate (TPP), in the range of about 0 to 60, such as 10 to 15 percent, e.g. about 15 to 35.

Alkali metal silicate in the range of about 0 to 30, such as 5 to 25 percent, e.g. about 10 to 20.

Copolymer of polyacrylate and polymaleic anhydride alkali metal salt anti incrustation agent in the range of about 0 to 10, such as 2 to 8 percent, e.g. about 3 to 5.

Alkylene glycol viscosity control and gel-inhibiting agent in an amount in the range of about 5 to 30, such as 5 to 25 percent, e.g. about 5 to 15. The preferred viscosity control and gel-inhibiting agents are the alkylene glycol mono-alkylethers.

Phosphoric acid alkanol ester stabilizing agent in the range of 0 to 2.0 or 0.1 to 2.0, such as 0.10 to 1.0 percent.

Aluminum salt of fatty acid stabilizing agent in the range of about 0 to 5.0, such as 0.5 to 2.0 percent, e.g. about 0.1 to 1.0 percent.

Bleaching agent in the range of about 0 to 30, such as 2 to 20, e.g. about 5 to 15 percent.

Bleach activator in the range of about 0 to 15, such as 1 to 10, e.g. about 3 to 6 percent.

Sequestering agent for bleach in the range of about 0 to 3.0, preferably 0.5 to 2.0 percent, e.g. about 0.75 to 1.25 percent.

Anti-redeposition agent in the range of about 0 to 5.0, preferably 0.5 to 4.0 percent, e.g. 1.0 to 3.0 percent.

Optical brightener in the range of about 0 to 2.0, preferably 0.25 to 1.0 percent, e.g. 0.25 to 0.75 percent.

Enzymes in the range of about 0 to 3.0, preferrably 0.5 to 2.0 percent, e.g. 0.75 to 1.25 percent.

Perfume in the range of about 0 to 3.0, preferably 0.25 to 1.25 percent, e.g. 0.75 to 1.0 percent.

Dye in the range of about 0 to 0.10, preferably 0.0025 to 0.050, e.g. 0.0025 to 0.010 percent.

Various of the previously mentioned additives can optionally be added to achieve the desired function of the added materials.

Mixtures of the viscosity control and gel-inhibiting agents, e.g. the alkylene glycol alkyl ether anti-gel agents with the anti-settling stabilizing agent can be used and in some cases advantages can be obtained by the use of such mixtures.

In the selection of the additives, they will be chosen to be compatible with the main constituents of the detergent composition. In this application, as mentioned above, all proportions and percentages are by weight of the entire formulation or composition unless otherwise indicated.

The concentrated nonaqueous nonionic liquid detergent composition of the present invention dispenses readily in the water in the washing machine.

The liquid nonionic detergent compositions of the present invention are preferably nonaqueous, e.g. they are substantially anhydrous. Though minor amounts of water can be tolerated, it is preferred that the compositions contain less than 3%, preferably less than 2% and more preferably less than 1% water.

The presently used home washing machines normally use about 250 gms of powder detergent to wash and soften a full load of laundry. In accordance with the present invention only about 70–80 cc or about 85–110 gms of the concentrated liquid nonionic detergent composition is needed.

In an embodiment of the invention the detergent composition of a typical formulation is formulated using the below named ingredients:

| | Weight % |
|---|---|
| Nonionic surfactant detergent. | 30–50 |
| Acid terminated surfactant (complex). | 1.5–10.0 |
| Quaternary ammonium salt softener agent (complex). | 2.0–15 |
| Phosphate detergent builder salt. | 15–35 |
| Copolymer of polyacrylate and polymaleic anhydride alkali metal salt anti-encrustation agent (Sokalan CP-5). | 3–5 |
| Alkylene glycol viscosity control and gel-inhibiting agent. | 5–15 |
| Anti-redeposition agent. | 1–3.0 |
| Alkali metal perborate bleaching agent. | 5–15 |
| Bleach activator (TAED). | 3.0–6.0 |
| Alkanol phosphoric acid ester (Empiphose 5632). | 0–3.0 |
| Sequestering agent. | 0.75–1.25 |
| Optical brightener (Stilbene Brightener N4). | 0.25–0.75 |
| Enzymes (Protease-Esperase SL8). | 0.75–1.25 |
| Perfume. | 0–3.0 |
| Dye (Blue Foulon Sandolan). | 0–0.10 |

The present invention is further illustrated by the following examples.

EXAMPLE 1

A concentrated nonaqueous liquid nonionic surfactant detergent composition is formulated from the following ingredients in the amounts specified.

| | Weight % |
|---|---|
| Mixture of $C_{13}$–$C_{15}$ fatty alcohol condensed with 7 moles of propylene oxide and 4 moles ethylene oxide and $C_{13}$–$C_{15}$ fatty alcohol condensed with 5 moles propylene oxide and 10 moles ethylene oxide. | 40 |
| Acid terminated Dobanol 91-5 reaction product with succinic anhydride (complex). | 2.0 |
| Quaternary ammonium salt[1] (complex). | 6.0 |
| Sodium tri polyphosphate (TPP). | 26.5 |
| Diethylene glycol monobutylether anti-gel agent | 10.0 |
| Sodium perborate monohydrate bleaching agent. | 10.0 |
| Tetraacetylethyene diamine (TAED) bleach activator. | 4.0 |
| Stilbene brightener. | 0.5 |

-continued

| | Weight % |
|---|---|
| Protease (Esperase). | 1.0 |

[1]The quaternary amine salt softener agent used is Ethoquat 2T14 which is the di-tallow diethoxy (x + y = 4) quaternary ammonium chloride.

The addition of the acid terminated nonionic surfactant/quaternary ammonium salt is found to substantially increase the fabric softening properties of the formulation without decreasing the detergent properties of the formulation.

The formulation is ground for about 1 hour to reduce the particle size of the suspended builder salts to less than 40 microns. The formulated detergent composition is found to be stable and non-gelling in storage and to have a high detergent capacity.

Dirty laundry was washed using the surfactant detergent composition in an automatic washing machine and dried. The dried laundry was checked and found to be very soft to the touch or feel.

EXAMPLE 2

Two concentrated nonaqueous liquid nonionic surfactant detergent compositions were formulated from the following ingredients in the amounts specified.

| | A | B |
|---|---|---|
| Mixture of $C_{13}$–$C_{15}$ fatty alcohol condensed with 7 moles of propylene oxide and 4 moles ethylene oxide and $C_{13}$–$C_{15}$ fatty alcohol condensed with 5 moles propylene oxide and 10 moles ethylene oxide. | 13.5 | — |
| Surfactant T7. | 10.0 | 15.0 |
| Surfactant T9. | 10.0 | 15.0 |
| Dubanol 91-5 Acid Term (complex). | 5.0 | 2.5 |
| Quaternary Ammonium Salt.[1] (complex) | — | 7.5 |
| Sodium tri-polyphosphate (TPP NW). | 29.7 | 29.5 |
| Copolymer of polyacrylate and polymaleic anhydride alkali metal salt anti-encrustation agent (Sokalan CP-5). | 4.0 | 4.0 |
| Diethylene glycol mono butyl ether. | 10.0 | 10.0 |
| Anti-redeposation agent (Relatin DM 4096 (CMC/MC).[2] | 1.0 | 1.0 |
| Alkanol Phosphoric Acid Ester (Empiphos 5632). | 0.3 | — |
| Sodium Perborate (mono-hydrate). | 9.0 | 9.0 |
| TAED | 4.5 | 4.5 |
| Sequestering agent (Dequest 2066). | 1.0 | 1.0 |
| Optical brightener.[3] | 0.5 | 0.5 |
| Esperase | 1.0 | 1.0 |
| Blue Foulon Sandolan (dye). | 0.0075 | 0.0075 |
| Perfume | 0.4925 | 0.4925 |

[1]Ethoquat 2T14 which is the di-tallow diethoxy (x + y = 4) quaternary ammonium choride.
[2]A 2:1 mixture of sodium carboxymethyl cellulose and hydroxy methyl cellulose.
[3]Optical brightener.

The two formulations were ground for about 60 minutes to reduce the particle size of the suspended builder salts to less than 40 microns. The two formulations were tested in a mini-wash at 45° C., and an ambient temperature of 10° C. to wash dirty laundry.

A comparison of the test results obtained with inventive composition B with the acid terminated nonionic surfactant/quaternary ammonium salt softener macro salt complex to composition A with only the acid terminated nonionic surfactant gave the following results.

Performance: ΔRd

| | A | B |
|---|---|---|
| Wine | 32 | 30 |
| Cecemel | 21 | 21 |
| Krefeld | 22 | 22 |

Softness: The quaternary ammonium salt deposition is evidenced by bromophenol blue in formulation B. A slight but significant (greater than 95%) superiority is evidenced for B by ten panelists.

The data obtained show that the addition to the formulation of as little as 7.5% quaternary ammonium salt softening agent in the form of the macro salt complex with the acid terminated nonionic surfactant of the present invention substantially increased the softening properties without significantly adversely effecting the detergency properties of the formulation.

The formulations of Examples 1 and 2 can be prepared without grinding the builder salts and suspended solid particles to a small particle size, but best results are obtained by grinding the formulation to reduce the particle size of the suspended solid particles.

The builder salts can be used as provided or the builder salts and suspended solid particles can be ground or partially ground prior to mixing them with the nonionic surfactant. The grinding can be carried out in part prior to mixing and grinding completed after mixing or the entire grinding operation can be carried out after mixing with the liquid surfactant. The formulations containing suspended builder and solid particles less than 40 microns in size are preferred.

It is understood that the foregoing detailed description is given merely by way of illustration and that variations may be made therein without departing from the spirit of the invention.

What we claim is:

1. A nonaqueous nonionic liquid detergent composition for cleaning and imparting softness to fabrics which comprises 10 to 70% of a nonionic surfactant, and 2.5 to 35% of a macro salt complex of a polycarboxylic acid terminated nonionic surfactant and a cationic quaternary salt softener, where the polycarboxylic acid terminated nonionic surfactant is the reaction product of a nonionic surfactant which is a poly $C_2$ to $C_3$ alkoxylated fatty alcohol having a terminal OH group and a polycarboxylic acid or polycarboxylic acid anhydride, and the quaternary ammonium salt softener is a member selected from the group consisting of a mono-higher alkyl tri-lower alkyl quaternary amine salt (I), di-higher alkyl di-lower alkyl quaternary amine salt (II), mono-higher alkyl mono-lower alkyl diethoxylated quaternary ammonium salt (III), and di-higher alkyl diethoxylated quaternary ammonium salt (IV), wherein the ratio of the polycarboxylic acid terminated nonionic surfactant to the quaternary ammonium salt used to form the macro complex is about 1.3:1 to 1:1.3.

2. The detergent composition of claim 1 wherein the macro salt complex comprises about equal molar amounts of the polycarboxylic acid terminated nonionic surfactant and the cationic quaternary ammonium softener salt.

3. The composition of claim 1 wherein the cationic quaternary amine salt is represented by the formula:

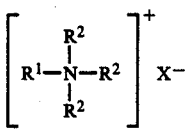

(I)

wherein $R^1$ is a long chain aliphatic radical having from 10 to 22 carbon atoms, and the $R^2$'s are, independently, lower alkyl or hydroxy alkyl radicals and X is a water soluble salt forming anion.

4. The composition of claim 1 wherein the cationic quaternary amine salt is represented by the formula:

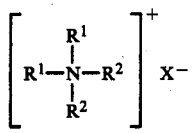

(II)

wherein $R^1$'s are, independently, long chain aliphatic radicals having from 10 to 22 carbon atoms, and the $R^2$'s are, independently, lower alkyl or hydroxy alkyl radicals and X is a water soluble salt forming anion.

5. The composition of claim 1 wherein the cationic quaternary amine salt is represented by the formula:

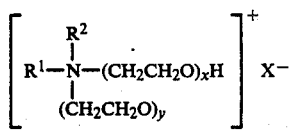

(III)

wherein $R^1$ is a long chain aliphatic radical having from 10 to 22 carbon atoms, and the $R^2$ is lower alkyl or hydroxy alkyl radical, x and y are each positive numbers of at least 1 and the sum of x+y is from 2 to 15, and X is a water soluble salt forming anion.

6. The composition of claim 1 wherein the cationic quaternary amine salt is represented by the formula:

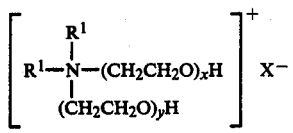

(IV)

wherein $R^1$'s are, independently, long chain aliphatic radicals having from 10 to 22 carbon atoms, x and y are each positive numbers of at least 1 and the sum of x+y is from 2 to 15, and X is a water soluble salt forming anion.

7. The detergent composition of claim 1 comprising 30 to 50 percent of a liquid nonionic surfactant detergent.

8. The detergent composition of claim 1 comprising one or more detergent adjuvants selected from the following: an inorganic detergent builder salt, anti-incrustation agent, alkali metal silicate, bleaching agent, bleach activator, sequestering agent, anti-redeposition agent, optical brightener, enzymes, perfume and dye.

9. The composition of claim 8 wherein the inorganic builder salt comprises an alkali metal polyphosphate.

10. The composition of claim 1 wherein the acid terminated nonionic surfactant in the macro complex comprises 1 to 15% by weight, based on weight of the composition.

11. The composition of claim 1 which contains in the macro complex from about 1.5 to about 20 percent by weight, based on the total composition, of the quaternary ammonium salt softener.

12. A nonaqueous heavy duty, built laundry detergent composition which is pourable at high and low temperatures and does not gel when mixed with cold water, said composition comprising at least one liquid nonionic surfactant in an amount of from about 20 to about 60 percent by weight;

at least one inorganic detergent builder salt suspended in the nonionic surfactant in an amount of from about 10 to about 50 percent by weight;

about 1.5 to 10% by weight of a polycarboxylic acid terminated nonionic surfactant, which is the reaction product of a nonionic surfactant which is a poly C2 to C3 alkoxylated fatty alcohol having a terminal OH group and a polycarboxylic acid or polycarboxylic acid anhydride, in a macro salt complex with about 2.0 to 15 percent by weight of a quaternary ammonium salt softener agent which is a member selected from the group consisting of a mono-higher alkyl tri-lower alkyl quaternary ammonium salt (I), di-higher alkyl di-lower alkyl quaternary ammonium salt (II), mono-higher alkyl mono-lower alkyl diethoxylated quaternary ammonium salt (III) and di-higher alkyl diethoxylated quaternary ammonium salt (IV).

13. The detergent composition of claim 12 which comprises about 5 to 30 percent by weight of an alkylene glycol mono alkyl ether viscosity control and gel inhibiting additive.

14. The detergent composition of claim 12 which optionally contains, one or more detergent adjuvants selected from the following: enzymes, corrosion inhibitors, anti-foam agents, suds suppressors, soil suspending or anti redeposition agents, anti-yellowing agents, colorants, perfumes, optical brighteners, bluing agents, pH modifiers, pH buffers, bleaching agents, bleach stabilizers, bleach activators, enzyme inhibitors and sequestering agents.

15. A nonaqueous liquid heavy duty laundry detergent composition of claim 12 which comprises

| | Weight % |
|---|---|
| Nonionic surfactant in an amount of about | 30–50 |
| Polycarboxylic acid Terminated nonionic surfactant in the macro complex an amount of about | 2.0–5.0 |
| Quaternary ammonium softener salt in the macro complex an amount of about | 5–10 |
| Sodium Tri polyphosphate (TPP) in an amount of about | 15–35 |
| Diethylene glycol monobutylether in an amount of about | 5–15 |
| Sodium perborate monohydrate bleaching agent in an amount of about | 5–15 |
| Tetraacetylethylene diamine (TAED) bleach activator in an amount of about | 3–6 |

16. A method for cleaning and imparting softness to fabrics which comprises washing the fabrics in an automatic washing machine which has a wash cycle and a rinse cycle with a detergent composition of claim 1 comprising a macro salt complex of an acid terminated nonionic surfactant and a cationic quaternary ammonium salt softener whereby the macro salt complex during the wash cycle is slowly hydrolyzed in the wash liquor to slowly release the quaternary ammonium softener salt for deposition onto the fabrics.

17. The composition of claim 1 wherein the 10–70% nonionic surfactant is a $C_9$ to $C_{18}$ alkyl alcohol containing 3 to 12 lower alkoxy groups.

18. The composition of claim 1 wherein the 10–70% nonionic surfactant is a $C_9$ to $C_{11}$ alkyl alcohol containing 5 to 8 lower alkoxy group.

19. The composition of claim 1 wherein the 10–70% nonionic surfactant is a $C_{12}$ to $C_{15}$ alkyl alcohol containing 5 to 9 lower alkoxy group.

20. A method for cleaning and imparting softness to fabrics which comprises washing the fabrics in an automatic washing machine which has a wash cycle and a rinse cycle with the detergent composition of claim 2 comprising a macro salt complex of an acid terminated nonionic surfactant and a cationic quaternary ammonium salt softener whereby the macro salt complex during the wash cycle is slowly hydrolyzed in the wash liquor to slowly release the quaternary ammonium softener salt for deposition on the fabrics.

21. A method for cleaning and imparting softness to fabrics which comprises washing the fabrics in an automatic washing machine which has a wash cycle and a rinse cycle with the detergent composition of claim 12 comprising a macro salt complex of an acid terminated nonionic surfactant and a cationic quaternary ammonium salt softener whereby the macro salt complex during the wash cycle is slowly hydrolyzed in the wash liquor to slowly release the quaternary ammonium softener salt for deposition on the fabrics.

22. A method for cleaning and imparting softness to fabrics which comprises washing the fabrics in an automatic washing machine which has a wash cycle and a rinse cycle with the detergent composition of claim 15 comprising a macro salt complex of an acid terminated nonionic surfactant and a quaternary ammonium salt softener whereby the macro salt complex during the wash cycle is slowly hydrolyzed in the wash liquor to slowly release the quaternary ammonium softener salt for deposition on the fabrics.

* * * * *